United States Patent [19]

van Bilderbeek

[11] 4,294,471

[45] Oct. 13, 1981

[54] SUBSEA FLOWLINE CONNECTOR

[75] Inventor: Bernard H. van Bilderbeek, Monymusk, Scotland

[73] Assignee: Vetco Inc., Ventura, Calif.

[21] Appl. No.: 99,183

[22] Filed: Nov. 30, 1979

[51] Int. Cl.[3] ..... F16L 55/00

[52] U.S. Cl. ..... 285/24; 166/344

[58] Field of Search ..... 285/24, 27, 18; 166/344, 347

[56] References Cited

U.S. PATENT DOCUMENTS

| | | | |
|---|---|---|---|
| 3,199,553 | 8/1965 | Garrett et al. | 285/24 X |
| 3,710,859 | 1/1973 | Hanes et al. | 166/344 X |
| 3,921,684 | 11/1975 | Allen | 285/24 X |
| 4,036,295 | 7/1977 | Kirkland et al. | 166/344 X |
| 4,223,839 | 9/1980 | Bleakney | 285/24 X |

*Primary Examiner*—Thomas F. Callaghan

*Attorney, Agent, or Firm*—Edward L. Kochey, Jr.

[57] ABSTRACT

A subsea flowline connector for connecting a horizontal flowline on a seabed to a vertical riser. A flowline flange on the end of the flowline is held in a preselected location while a rigid tubular spool piece is stroked into sealing relationship therewith. The spool piece is rigid and has horizontally and vertically extending portions. It is guided so that the entire spool piece moves with the stroking and the vertical stab with the riser is made after the sealing stroke is effected.

3 Claims, 2 Drawing Figures

SUBSEA FLOWLINE CONNECTOR

BACKGROUND OF THE INVENTION

This invention relates to subsea pipeline connections and in particular to an apparatus for connecting a horizontally extending flowline to a vertically extending production riser.

It is common practice today when completing underwater wells to run flowlines from various wellheads along the seabed to a remotely located production facility. The production facility will normally include a plurality of production risers to which the flowlines must be connected.

When remote flowline installation methods are used, it is usually required that some form of seal be remotely set between the connecting point at the riser and the flowline. For this purpose a stroking action of one of the mating ends is required. While the flowline must be pulled to bring it into an initial position, stroking of the flowline for sealing purposes is unreliable since a large portion of the flowline must be moved each time and the force requirements will be erratic.

Therefore, it has been conventional to stroke the riser end of the connection. This has been accomplished by the use of flexible loops which accommodate the stroking motion by flexing of the loops. This requires a relatively large loop pipe section and stroking takes considerable force where the size of the connecting pipe is large. It also takes considerable space since enough length must be allowed to permit the required movement of the stroked flange without overstraining the flexing pipe.

Alternatively, use has been made of a slip joint where stroking is permitted by one tubular member sliding within a second member with a seal between the two. This relies on sliding type seals at a location where replacement is relatively difficult. Such seals are less reliable than a straight compression seal because of the sliding and potential rolling action on the seal itself.

SUMMARY OF THE INVENTION

The flowline connecting apparatus has means for holding a flowline flange, which flange is located on one end of a subsea flowline and has a sealing surface on the face thereof. A rigid tubular spool piece has a horizontally extending portion with a spool piece flange located on the end, and the spool piece flange is adapted to mate and seal with the flowline flange. The spool piece also has a generally vertically extending portion with a stab connection being provided at the upper end. In relation to the means for holding the flowline, there is also provided a means for guiding movement of the rigid spool piece in a direction such that the spool flange moves generally perpendicular to its sealing surface into and out of engagement with the flowline flange. Means are provided for stroking the entire spool piece to produce the guided movement without any flexing of the spool piece.

With the spool piece generally in the form of a 90° bend, both the vertical and horizontal portions are guided to move perpendicular to the sealing surface. The apparatus is arranged so that when the spool piece is stroked into sealing relationship with the flowline flange, the riser is in stabbing relationship and may be stabbed over the spool piece. This effectively locks the spool piece into the sealed position.

The vertical portion of the spool piece may be alternately located at a position in the plane of the sealing surface. It may then be guided for rotation around its location, and stroking of the horizontal portion perpendicular to the sealing surface results in an arc with its center at the vertical stab location.

By this arrangement, the slip joint of the prior art and its concomitant disadvantages may be omitted and a very compact arrangement may be provided since a large flexible loop is not required. This is particularly advantageous where large flowlines are being used which would result in very large and highly stressed flexible loops according to the prior art.

DESCRIPTION OF THE PREFERRED EMBODIMENT

Figure 1:
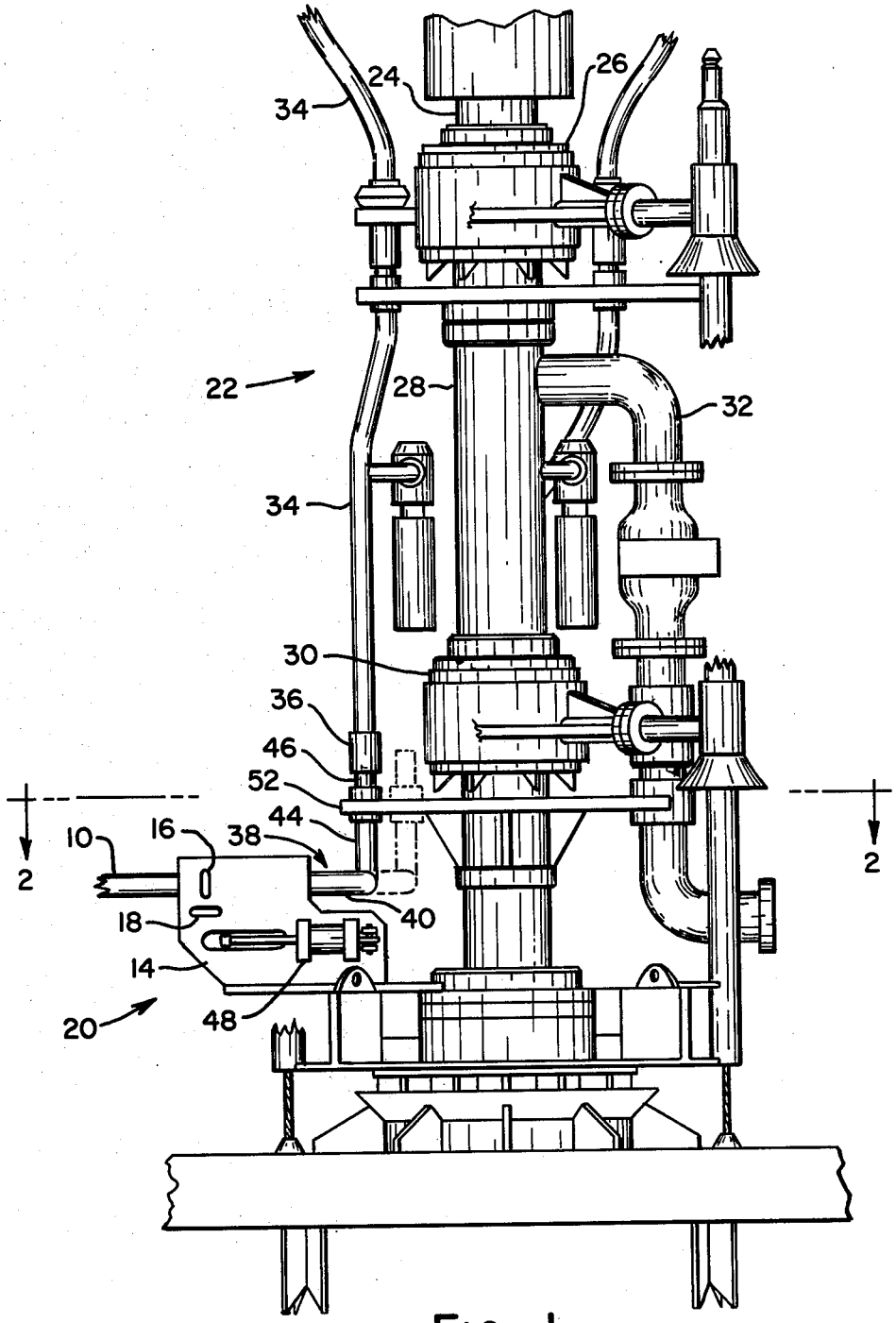
FIG. 1 is a side elevation of the flowline connector located near the seabed at the bottom of a production riser assembly.
Figure 2:
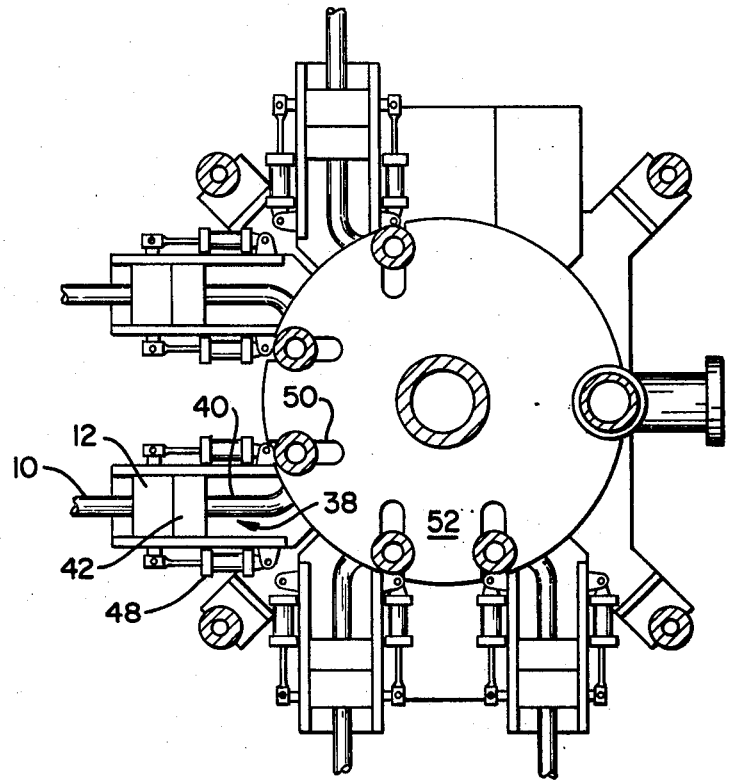
FIG. 2 is a sectional plan view of FIG. 1.

A flowline 10 passing along the seabed has a flowline flange 12 located on one end thereof. This flange is of the conventional type which has one or more sealing surfaces on the face thereof depending on the number of individual lines comprising the flowline. It also has various locking dogs adapted to lock and hold the flange in a preselected location. Such typical flowline flanges are illustrated as item 40 in U.S. Pat. No. 3,924,446 and U.S. Pat. No. 3,866,677.

An alignment and anchor plate 14 is provided with slots 16 and 18 which engage dogs on the flowline flange 12. A pair of these anchor plates is supplied for each flowline, and they operate to hold the end of the flowline in a preselected location. The anchor plate 14 is securely fastened to and forms a portion of the permanent guide structure 20, which is spudded and anchored in the seabed.

The production riser assembly 22 includes a central riser 24 which passes upwardly to a production platform. The central riser is attached to the permanent guide structure by means of a releasable coupling 26, a riser segment 28 and a second releasable connector 30. Where the central riser is used to return oil to a subsea flowline, there may be provided a processed fluid connector 32 which may also include the inventive connection.

The riser assembly also includes a plurality of production risers 34 with female stab receptacles 36 located at their lower end. These receptacles 36 are located at precise locations with respect to the central riser for the purpose of assuring connection and sealing when stabs are made over male receptacles to which they are to seal.

There is provided for each flowline a rigid tubular spool piece 38. Each spool piece has a horizontally extending portion 40 which has a spool piece flange 42 located on the end. This flange has a sealing surface on its face which is adapted to mate with sealing surfaces on flowline flange 12. As indicated in solid lines, the flange is located in sealing relationship.

The spool piece also has a vertically extending portion 44 which has a male receptacle 46 located on the upper end thereof. With the flange in the sealing location, the entire spool piece is as indicated by the solid lines and the male receptacle is in vertical alignment with the female receptacle 36 and the production riser 34. In this location a vertical stab may be made over the male receptacle 46.

Stroking cylinders 48 operate to stroke the spool piece flange with respect to the permanent guide structure between the sealing location illustrated by solid lines and the uncoupled position illustrated by the dashed lines. The lower portion of the spool piece is guided through the anchor plate 14 while the upper portion of the spool piece is guided by slots 50 located in stab plate 52. The spool piece is a rigid member with no bending, flexing or sliding occurring within the spool piece itself. When making a connection, the spool piece is located in its uncoupled position; and the flowline 10 is pulled into location and locked in anchor plate 14. With the flowline being so held at the predetermined location, the entire spool piece is stroked by the action of hydraulic cylinders 48 into sealing engagement with the flowline. Thereafter the vertical stab of female receptacle 36 is made which effectively locks the spool piece into position. Where resilient seals are used, this locks the spool piece in the sealed condition.

Normally it would not be required to disconnect the flowline without removal of the entire production riser assembly, and, accordingly, the withdrawal of the receptacle 36. Should, however, it be desired to permit disconnection of the flowline without withdrawing the entire assembly, receptacle 36 may be a special sub which can be hydraulically retracted.

I claim:

1. An apparatus for connecting a horizontal subsea flowline having a first sealing surface at one end thereof, to a generally vertical production riser comprising: means for holding an end of said flowline at a predetermined location; a rigid tubular spool piece having, a generally horizontally extending portion, a generally vertically extending portion, and a second sealing surface at the end of said horizontal portion and adapted to mate with said first sealing surface; guide means for guiding movement of the end of the horizontal portion of said spool piece substantially perpendicular to said second sealing surface, and for guiding movement of the end of the vertical portion of said spool piece in a manner to maintain it a fixed distance from the end of the horizontal portion of said spool piece; means for stroking said entire spool piece in a manner producing the guided movement of said spool piece; and stab means for stabbing and sealing the vertical riser on the upper end of said vertically extending portion of said spool piece.

2. An apparatus as in claim 1 wherein said flowline has a flowline flange at the ends thereof with said first sealing surface being located on said flowline flange comprising: a spool flange located at the end of said horizontally extending portion of said spool piece, and having said second sealing surface located on said spool flange; and said means for holding said flowline comprising means for holding said flowline flange.

3. An apparatus as in claim 1 or 2 wherein said guide means also comprises means for guiding movement of the entire spool piece substantially perpendicular to said second sealing surface; and said stab means is located so that it is in alignment with said vertical riser only when said spool piece is stroked into a sealing position with said first sealing surface.

* * * * *